US006604304B1

(12) United States Patent
Slabach et al.

(10) Patent No.: US 6,604,304 B1
(45) Date of Patent: Aug. 12, 2003

(54) DUAL MODE EVACUATION SYSTEM FOR VACUUM EXCAVATOR

(75) Inventors: Freeman Slabach, Kalona, IA (US); Lance Slabach, Kalona, IA (US); Herman Slabach, Kalona, IA (US)

(73) Assignee: Slabach Enterprises, Inc., Kalona, IA (US)

( * ) Notice: Subject to any disclaimer, the term of this patent is extended or adjusted under 35 U.S.C. 154(b) by 0 days.

(21) Appl. No.: 10/063,746

(22) Filed: May 9, 2002

Related U.S. Application Data

(63) Continuation-in-part of application No. 09/680,075, filed on Oct. 6, 2000, now Pat. No. 6,385,867.

(51) Int. Cl.[7] ..... B60P 1/00
(52) U.S. Cl. ..... 37/304; 37/905
(58) Field of Search ..... 37/304, 905, 466, 37/317, 320; 15/300.1, 312.2, 318.1, 321, 330, 340.1, 345, 346, 352

(56) References Cited

U.S. PATENT DOCUMENTS

| | | | | | |
|---|---|---|---|---|---|
| 3,007,191 | A | * | 11/1961 | Braun | 15/346 |
| 4,017,281 | A | * | 4/1977 | Johnstone | 55/334 |
| 5,016,717 | A | | 5/1991 | Simons et al. | |
| 5,055,204 | A | * | 10/1991 | Bogart | 210/758 |
| 5,200,033 | A | * | 4/1993 | Weitzman | 159/47.1 |
| 5,249,368 | A | * | 10/1993 | Bertino et al. | 34/406 |
| 5,295,317 | A | | 3/1994 | Perrott | |
| 5,299,370 | A | * | 4/1994 | Gyori et al. | 37/347 |
| 5,361,855 | A | * | 11/1994 | Schuermann et al. | 175/67 |
| 5,408,766 | A | * | 4/1995 | Pobihushchy | 37/323 |
| 5,425,188 | A | * | 6/1995 | Rinker | 37/317 |
| 5,487,229 | A | * | 1/1996 | Nathenson et al. | 37/347 |
| 5,722,113 | A | * | 3/1998 | Baziuk | 15/352 |
| 5,860,232 | A | * | 1/1999 | Nathenson et al. | 37/466 |
| 5,946,767 | A | * | 9/1999 | Sinz | 15/302 |
| 6,016,839 | A | | 1/2000 | Raftis et al. | |
| 6,202,330 | B1 | * | 3/2001 | Bolton | 37/403 |
| 6,385,867 | B1 | * | 5/2002 | Slabach et al. | 37/304 |
| 6,470,605 | B1 | * | 10/2002 | Gilman et al. | 37/323 |

FOREIGN PATENT DOCUMENTS

| | | | | |
|---|---|---|---|---|
| JP | 58-222223 | * | 12/1983 | |
| JP | 404277226 | * | 10/1992 | 37/905 |

* cited by examiner

*Primary Examiner*—Victor Batson
(74) *Attorney, Agent, or Firm*—James C. Nemmers

(57) ABSTRACT

The present invention is an improved vacuum excavation system for use in the excavation of earth, waste, or other materials. A liftable and pivotable slurry or spoils tank and vacuum system are mounted on a mobile base. If required, a fluid source may be used to loosen earth or hard-packed material that may be drawn into the tank by the vacuum system. The slurry tank includes a manifold system that may receive air or other fluid to agitate the slurry or spoils to facilitate the release of solids from the tank. An exit port is provided in the tank to allow controlled release of the slurry. A valve means is utilized to allow for the use of a pump or air moving system wherein flow may be directed alternatively between the vacuum function to draw a slurry stream into the tank and a pressurizing function wherein air or other fluid is forced into the tank through the manifold system.

10 Claims, 5 Drawing Sheets

DUAL MODE EVACUATION SYSTEM FOR VACUUM EXCAVATOR

BACKGROUND OF INVENTION

The present invention relates to a system for the excavation of dirt, water or other material from an excavation site through the use of a vacuum to draw material into a spoils tank, and through the use of a pneumatic or hydraulic system to agitate spoils in the tank so that solids are suspended for convenient evacuation of the tank. The use of vacuum excavation as a means for the removal of dirt, water, or other material from an excavation site, or in the handling of liquid waste streams (manure, etc.) is known and has been practiced in the prior art. Vacuum excavation is widely considered to be superior to traditional excavation techniques such as manual or mechanical digging. Vacuum excavation typically involves the use of a vacuum system to pull a slurry or debris stream that may exist or that may be created by the use of compressed air, high pressure water, or other mediums capable of loosening hard-packed material.

Important applications for vacuum excavation systems include environmental cleanup, the collection of the slurry created in the process of directional drilling and the "pot-holing" of utilities as well as other applications. "Pot-holing" refers to the excavation of a hole to access or view utilities. Pot-holing is preferred over prior art techniques such as digging with shovels, backhoes, etc., which often results in damage to the utilities and a corresponding demand for expensive repair and reconstruction. Depending on the utility, such damage may present danger to workers or nearby residents in addition to increased costs necessarily associated with repair and increased labor costs associated with digging. When the vacuum excavation of a slurry is utilized for pot-holing, access is possible without risk of damage to the utilities. In addition, when the vacuum excavation is coupled with radar or other utility locating techniques, the amount of excavation required may be minimized.

Prior art vacuum excavation systems, include those disclosed in U.S. Pat. Nos. 5,016,717 (1991, Simmons et. al., the "'717 patent") and 5,295,317 (1994, Perrott, the "'317 patent"). The '717 patent discloses a vehicle mounted vacuum excavation system having a tank mounted on a lift mechanism to facilitate the raising and tilting of the tank to release excavated materials by dumping through an openable rear hatch or end wall of the tank. The invention of the '717 patent allows for the settling of solids at a bottom region of the tank and provides for the addition of a vibrator to prevent compaction of particles and to facilitate release when the tank is tilted for dumping.

The '317 patent discloses a mobile vacuum excavation system and tank that features a slurry water recovery system to reuse excavation water. The '317 patent discloses a screen assembly and a dual chambered water tank to allow the use of recovered slurry water from a first chamber, supplemented with make-up water from the supplementary chamber. Therefore, the invention of the '317 patent seeks to minimize the retention of excavation materials by separating excavated solids from retrieved water and minimizing water usage associated with slurry creation. Although the reuse of slurry water in the invention of the '317 patent decreases the downtime required for tank evacuation and the environmental concerns associated with the dumping of excavated material, the '317 patent does not disclose an improved method for tank agitation and materials release.

It is therefore an object of the present invention to provide a system for the vacuum excavation of materials that allows the convenient suspension of solids in the slurry or spoils tank and allows controlled evacuation of the spoils tank through an evacuation line or port in addition to bulk evacuation of the spoils tank through an openable end wall in combination with a spoils tank tilt mechanism.

It is a further object of the present invention to provide such a system wherein air or other fluid delivered through a manifold system to the slurry or spoils tank provides agitation to the slurry.

It is a further object of the present invention to provide a pump and conduit system whereby vacuum generation in the tank and agitation or pressurization of the tank may be controlled through an air mover and valve assembly to consolidate the vacuum and pressurization functions to an air mover.

SUMMARY OF INVENTION

The present invention utilizes pneumatic or hydraulic agitation of a spoils tank to suspend vacuum-excavated materials for release thus facilitating the efficient emptying of the slurry tank via a controlled gravity and/or pressure-driven evacuation of the tank rather than, or as an alternative to, dumping through the tilting of the slurry or spoils tank. Release through a port or line rather than dumping allows for greater control during evacuation of the tank, which control may be important in applications involving contaminated spoils. By contrast release through dumping allows rapid release of all contents. Under the present invention, both evacuation methods are available for use in one unit to provide more diverse applicability of the unit.

A mobile base is provided upon which a spoils tank and air mover are provided. A fluid source such as a water tank and water pump may be provided, although, depending upon the location of the excavation site, external water sources may be available to provide a loosening agent. Manifolds within the spoils tank provide for the injection of air into the excavated material in the tank to cause or maintain suspension. Either a single engine or separate engines may be utilized to power a vacuum pump and a water pump to prevent excessive wear and to prevent the "pulling down" that can occur when only one engine is used. One engine may be utilized if that engine will provide sufficient power to drive both pumps. In addition, the preferred air mover in the present invention comprises a rotary vane pump to create a deeper vacuum than traditional blowers or alternative pumps, which typically are less capable of tolerating the foreign materials inherent in excavation applications.

DETAILED DESCRIPTION

Figure 1:
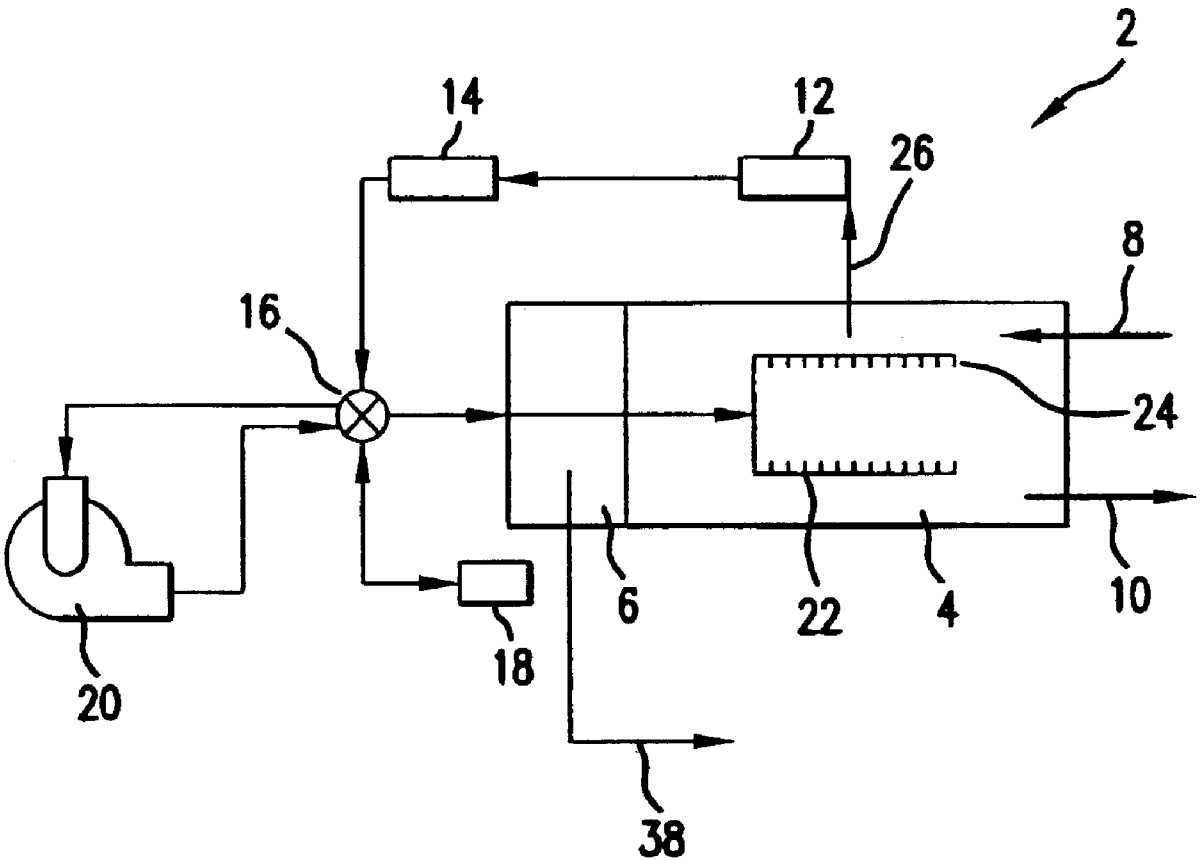
FIG. 1 is a schematic view of the vacuum excavator.

FIG. 1 demonstrates a schematic diagram of the preferred embodiment of the present invention. A dual compartment tank 2 contains a separate clean water reservoir 6 and spoils reservoir 4. Although the vacuum excavation may be practiced without a dual compartment tank and without a water reservoir, the dual compartment tank provides an efficient and compact arrangement on the mobile base and the provision of a water reservoir, whether in the dual compartment tank or in a separate tank, permits materials loosening even in locations where access to an external water source is not feasible. The water reservoir 6 may be a separate tank rather than a compartment, or the water source may be a convenient external source such as a water main or a source on an auxiliary vehicle. In addition, other fluids may be employed to achieve the material loosening that may be required. A primary example is compressed air. Other examples include hydrogen peroxide solutions or other solutions that may contain free-radicals useful for the break down of environmental contaminants. In clean-up applications, it may be desired to deliver oxygen or nutrients in solution to promote the digestion of contaminants.

A vacuum line 26 connected near the top of the spoils reservoir 4 draws air from the head space in the spoils reservoir 4 and creates the suction used to draw a slurry or debris stream from the excavation site. In order to protect the air mover, the vacuum line 26 of the preferred embodiment passes withdrawn air through a low velocity separator 12 and a filter 14 to remove much of the water or foreign material from the vacuum line. The preferred air mover 20 is a rotary vane pump because rotary vane pumps are superior at tolerating foreign material, and they typically create a deeper vacuum than alternative pumps. Exhaust from the pump 20 may pass either to the atmosphere (preferably through a muffler 18), or to a manifold system 22 in the spoils reservoir. The preferred embodiment is described with reference to a rotary vane pump as the air mover, however, blowers or other air movers may be used with the vacuum system and manifolds to provide the suction and to provide the air to the manifold. The preferred embodiment includes a single air mover used in combination with a valve system as described herein. However, it is intended that this description and the present invention also encompass the use of a separate vacuum and air source to provide the suction to the spoils reservoir and the air to the manifolds, respectively.

A valve 16 controls the supply and discharge paths of the pump 20. In preferred operation, the valve may allow the vacuum draw of the pump to pull air through the vacuum line 26 off of the head of the spoils reservoir 4 and exhaust the pump 20 through a muffler 18 to the atmosphere, or to an environmental control device (if the application and any harmful or controlled gasses demand such an attachment). When the spoils tank nears capacity, or when excavation is complete, and the operator desires to evacuate the spoils reservoir, the valve may be switched to allow the pump to exhaust into the manifold system 22 and to cease the draw of air from the slurry reservoir head through the vacuum line 26. In the preferred mode of operation, the valve alters the source for the vacuum draw of the pump to pull air back through the muffler.

The system may be mounted on a trailer, truck, or other convenient mobile base 28 to accommodate service calls and transportation to excavation sites. The manifold system of the present invention preferably utilizes a series of exhaust ports 24 directed downward and towards the centerline of the spoils tank reservoir bottom side . Although the desired agitation may be achieved through alternative manifold and port arrangements, effective suspension is provided by this preferred arrangement. The preferred embodiment also includes elastomeric "duckbilled" check valves or diffusers as described in U.S. Pat. No. 6,016,839 and produced by the Red Valve Co. of Carnegie, Pa. The valves of the '839 patent are preferred due to the superior ability of the elastomeric material to resist clogging with sediment or excavation solids.

In addition, the preferred power source for the present invention includes separate engines 32, 34 to drive the rotary vane pump 20 and a water pump 36. The water pump 36 may draw water through a water line 38 to loosen hard packed material or soil and to aid in the creation of a wet slurry. Although the preferred fluid for use in the loosening of packed material is pressurized water, any fluid, including air may serve as the necessary loosening agent depending upon the application and the material to be excavated. The use of two separate engines reduces the wear on each engine, thus enhancing excavator longevity, and eliminates the pulling down that may occur when both applications a draw power from the same source. Although the preferred embodiment employs two engines, one engine may be employed rather than two. In the event that the present invention is practiced with one engine, it is preferred to size the one engine to be capable of driving both the water and air systems without appreciable pulling down of the power or performance of either system.

In the preferred mode of operation, the slurry suction line 8 extends from the top region of the spoils reservoir, and a separate spoils evacuation line 10 is provided near the slurry reservoir bottom side. When the spoils tank is pressurized through agitation and cessation of the vacuum draw, the release of air through the manifold and diffusers causes or maintains suspension of solids and allows the agitated slurry to exit the spoils reservoir through the evacuation hose 10.

Figure 4:
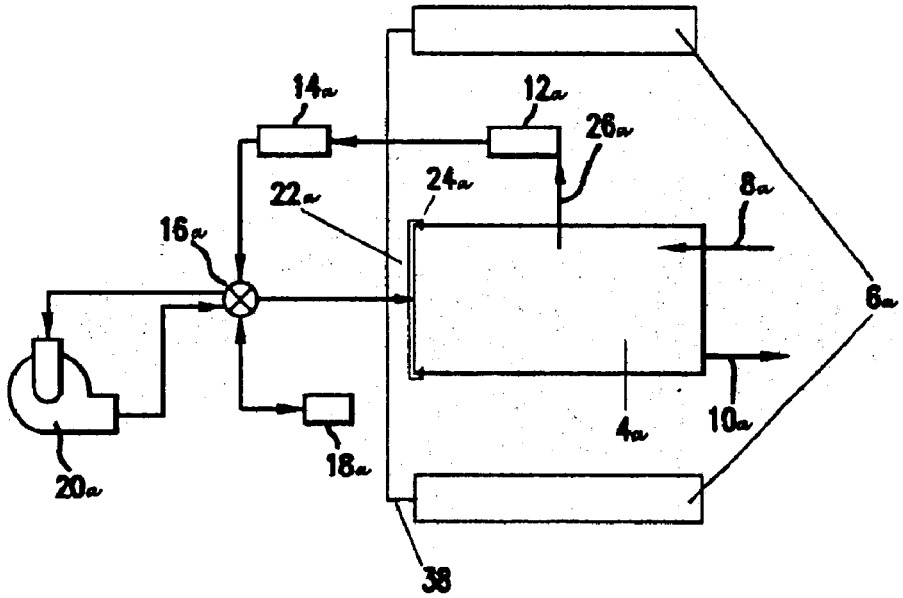
FIG. 4 is a schematic view of a second embodiment of the vacuum excavator.

Although the present invention provides an alternative means for evacuating the spoils tank, it may be desired to practice the present invention as a unit having the previously described evacuation system in combination with a tilt, or dump, body spoils tank having a lift member such as a hydraulic cylinder disposed upon the mobile base for raising the forward end of the spoils tank or slurry reservoir (which may be pivotally attached to the mobile base). Such an embodiment is illustrated in FIG. 4. If the manifold and agitation system is employed with such a design, additional or alternative hosing may be required to accommodate the rising dump body. Alternatively, the manifold and agitation system or a simplified nozzle arrangement may be designed to promote end wall dumping with nozzles or valves directed downward and toward the openable end wall to agitate slurry and effectively scour or clean the spoils tank or slurry reservoir bottom wall.

Figure 2:
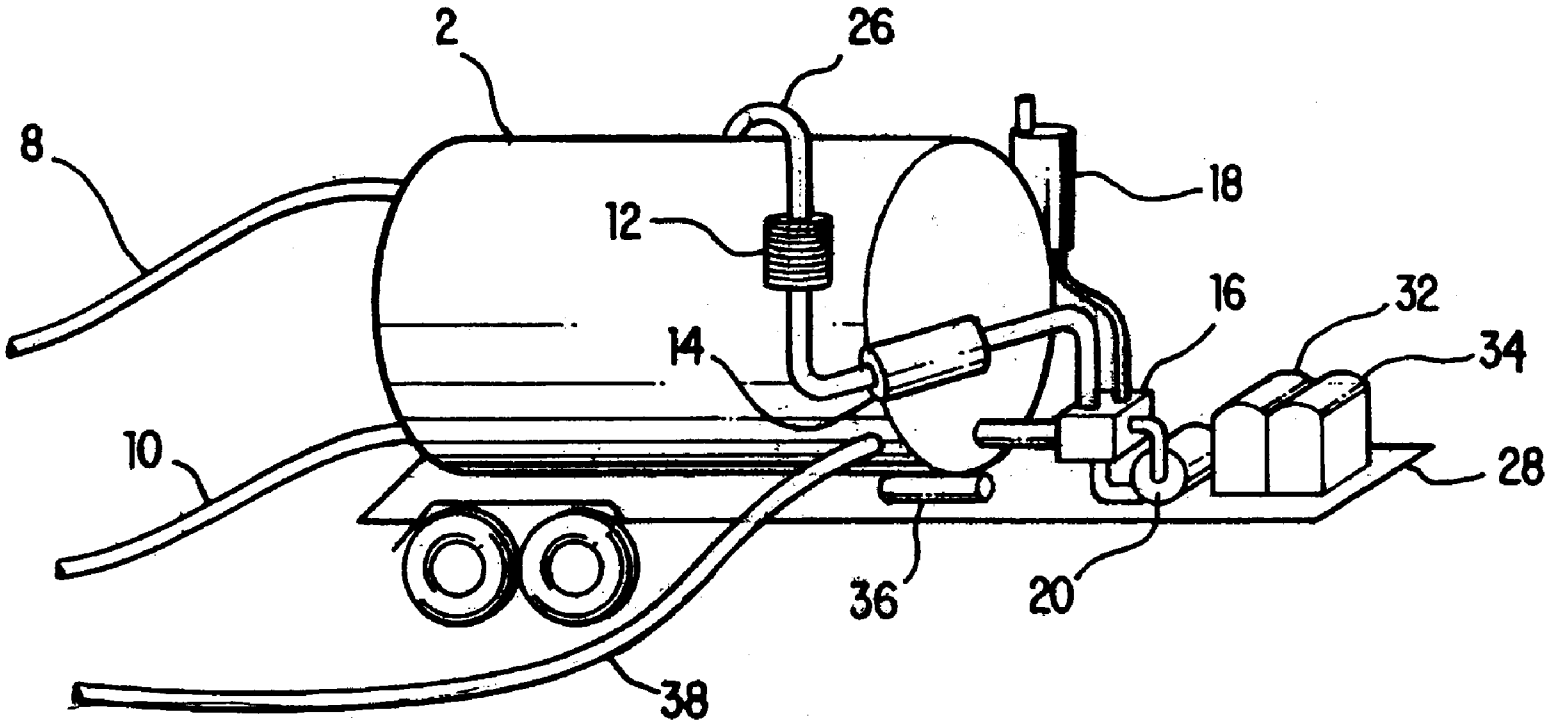
FIG. 2 is a perspective view of the vacuum excavator mounted on a mobile base.
Figure 3:
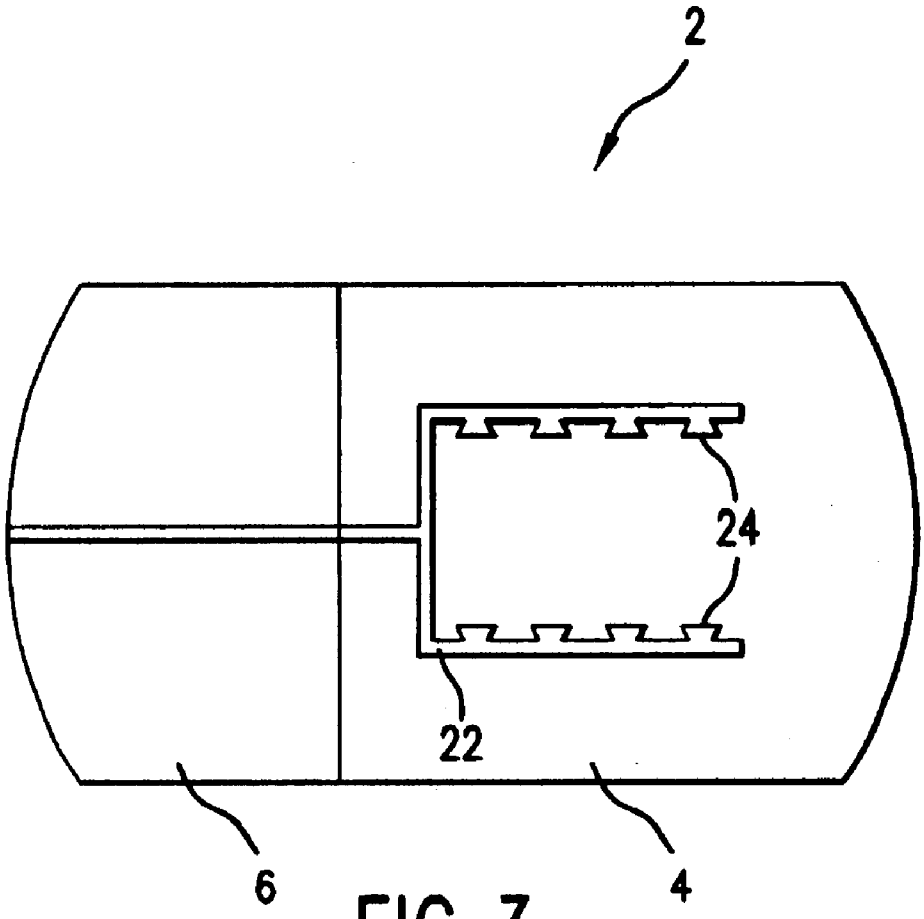
FIG. 3 is a detailed top view of the dual compartment tank and agitation manifolds.

Although the first embodiment of the present invention provides an alternative means for evacuating the spoils tank, it may be desired to practice the present invention with a unit having the previously described evacuation system in combination with a tilt, or dump, body spoils tank having a lift member such as a hydraulic cylinder disposed upon the mobile base for raising the forward end of the spoils tank or slurry reservoir (which may be pivotally attached to the mobile base). Such an embodiment is illustrated in FIG. 4 which illustrates a schematic diagram of a second preferred embodiment of the invention. Components in this second embodiment that are comparable to those of the embodiment of FIGS. 1–3 will be referred to using the same reference numerals but followed by the letter "a".

The system of this second embodiment includes two clean water tanks or reservoirs **6*a* and a separate tank or spoils reservoir 4. Although the vacuum excavation may be practiced without these water reservoirs, the dual reservoirs 6***a* provide for increase water capacity and better weight distribution on the mobile base. The provision of a water reservoir, whether in the dual compartment tank of the first embodiment or in separate dual tanks of this second embodiment, permits material loosening even in locations where access to an external water source is not feasible. It should be understood, however, that the water reservoirs may be in separate tanks rather than a compartment, or the water source may be a convenient external source such as a water main or a source on an auxiliary vehicle. In addition, other fluids may be employed to achieve the material loosening that may be required. A primary example is compressed air. Other examples include hydrogen peroxide solutions or other solutions that may contain free-radicals useful for the break down of environmental contaminants. In clean-up applications, it may be desired to deliver oxygen or nutrients in solution to promote the digestion of contaminants.

A vacuum line 26*a* connected near the top of the spoils reservoir 4*a* draws air from the head space in the spoils reservoir 4*a* and creates the suction used to draw a slurry or debris stream from the excavation site. In order to protect the air mover, the vacuum line 26*a* passes withdrawn air through a low velocity separator 12*a* and a filter 14*a* to remove much of the water or foreign material from the vacuum line. The preferred air mover 20*a* is a rotary vane pump because rotary vane pumps are superior at tolerating foreign material, and they typically create a deeper vacuum than alternative pumps. Exhaust from the pump 20*a* may pass either to the atmosphere (preferably through a muffler 18*a*), or to a manifold system 22*a* in the spoils reservoir 4*a*. This second embodiment is also described with reference to a rotary vane pump as the air mover, however, blowers or other air movers may be used with the vacuum system and manifolds to provide the suction and to provide the air to the manifold. The preferred embodiments includes a single air mover used in combination with a valve system as described herein. However, it is intended that the present invention also encompass the use of a separate vacuum and air source to provide the suction to the spoils reservoir and the air to the manifolds, respectively.

A valve 16*a* controls the supply and discharge paths of the pump 20*a*. In preferred operation, the valve 16*a* may allow the vacuum draw of the pump 20*a* to pull air through the vacuum line 26*a* off of the head of the spoils reservoir 4*a* and exhaust the pump 20*a* through a muffler 18*a* to the atmosphere, or to an environmental control device (if the application and any harmful or controlled gasses demand such an attachment). When the spoils tank 4*a* nears capacity, or when excavation is complete, and the operator desires to evacuate the spoils reservoir 4*a*, the valve 16*a* may be switched to allow the pump 20*a* to exhaust into the manifold system 22*a* and to cease the draw of air from the slurry reservoir head through the vacuum line 26*a*. In the preferred mode of operation, the valve 16*a* alters the source for the vacuum draw of the pump 20*a* to pull air back through the muffler 18*a*.

Figure 5:
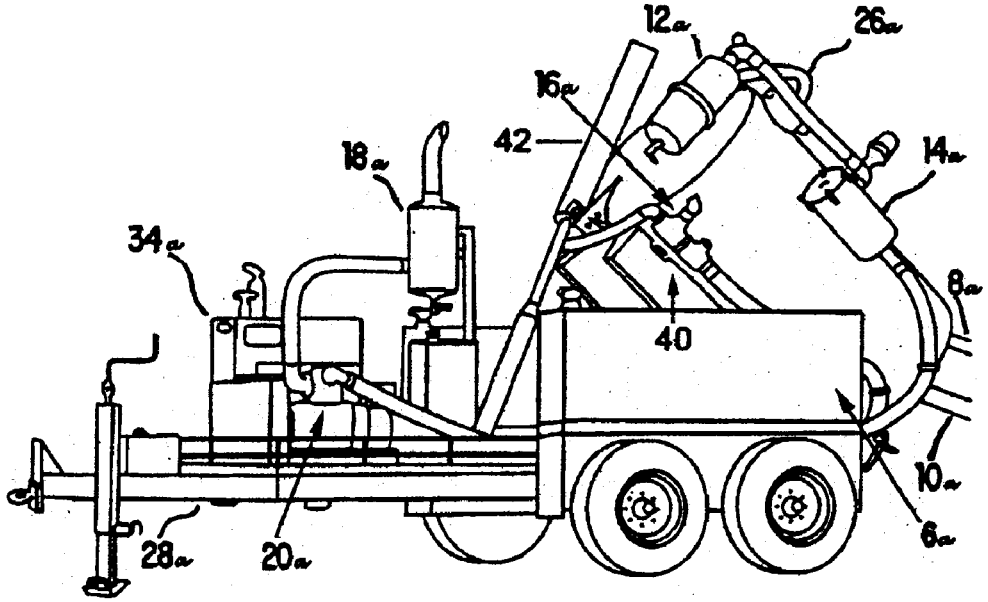
FIG. 5 is a perspective view of the vacuum excavator of FIG. 4 mounted on a mobile base.
Figure 6:
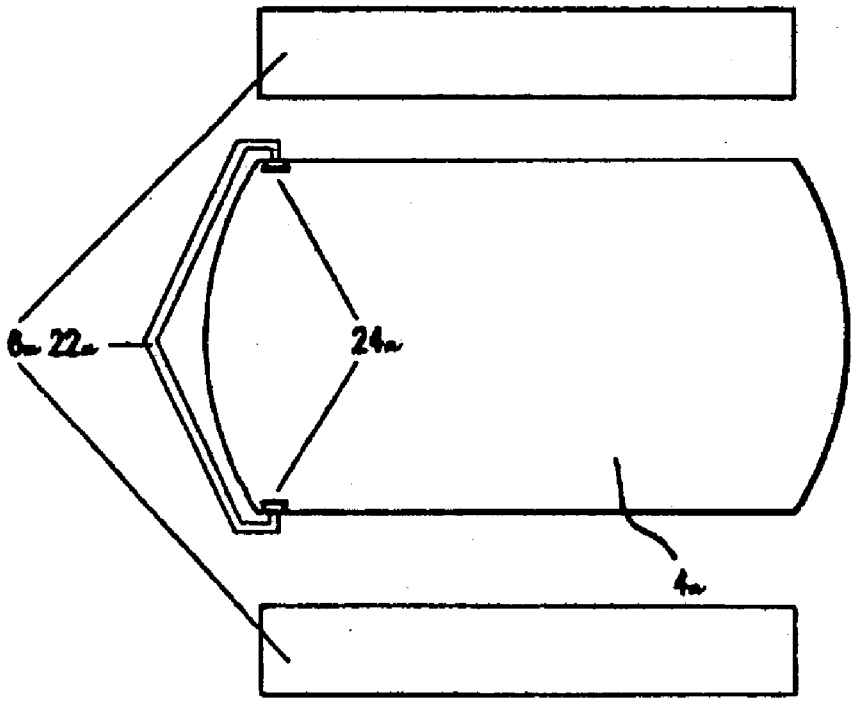
FIG. 6 is a detailed top view of the dual compartment tank and agitation manifolds of the second embodiment.

As illustrated in FIG. 5, the system may be mounted on a trailer, truck, or other convenient mobile base 28*a* to accommodate service calls and transportation to excavation sites. With this second embodiment, many of the components of the system are attached to tank that provides the spoils reservoir 4*a* as illustrated in FIG. 5. The tank that is the spoils reservoir 4*a* is mounted on a frame 40 the rear of which is pivotally mounted to the mobile base 28*a*. A hydraulic cylinder 42 has one end affixed to the mobile base 28*a* and the other end affixed to the front of the spoils reservoir 4*a* so that the reservoir can be elevated, thereby using gravity to assist in moving debris to the rear, bottom of the reservoir 4*a*. The manifold system of the present invention preferably utilizes a two air jets 24*a* directed inwardly at the front end of the spoils reservoir 4*a*. Thus, with this second embodiment, when the front of the spoils reservoir 4*a* is elevated by the hydraulic cylinder 42, debris in the reservoir will settle at the bottom of the reservoir, thus assisting the air from jets 24*a* to exhaust the debris through the evacuation hose 10*a*. or by opening the end wall of reservoir 4*a*.

In the preferred mode of operation, the slurry suction line 8*a* extends from the top region of the spoils reservoir, and a separate spoils evacuation line 10*a* is provided near the slurry reservoir bottom side. When the spoils tank is pressurized through agitation and cessation of the vacuum draw, the release of air through the manifold and diffusers causes or maintains suspension of solids and allows the agitated slurry to exit the spoils reservoir through the evacuation hose 10*a*.

This embodiment also includes elastomeric "duckbilled" check valves or diffusers as described in U.S. Pat. No. 6,016,839 and produced by the Red Valve Co. of Carnegie, Pa. The valves of the '839 patent are preferred due to the superior ability of the elastomeric material to resist clogging with sediment or excavation solids.

In addition, the preferred power source for the present invention includes a single engine 34*a* to drive the rotary vane pump 20*a* and a water pump 36*a*. As previously indicated, separate engines may be used to drive the pumps 20*a* and 36*a*. The water pump 36*a* may draw water through a water line 38*a* to loosen hard packed material or soil and to aid in the creation of a wet slurry. Although the preferred fluid for use in the loosening of packed material is pressurized water, any fluid, including air may serve as the necessary loosening agent depending upon the application and the material to be excavated. Since this embodiment of the invention is practiced with one engine, it is preferred to size the engine to be capable of driving both the water and air systems without appreciable pulling down of the power or performance of either system.

In this second embodiment, additional or alternative hosing may be required to accommodate the rising dump body. Alternatively, the manifold and agitation system or a simplified nozzle arrangement may be designed to promote end wall dumping with nozzles or valves directed downward and toward the openable end wall to agitate slurry and effectively scour or clean the spoils tank or slurry reservoir bottom wall.

Having thus described the invention in connection with the preferred embodiments thereof, it will be evident to those skilled in the art that various revisions can be made to the preferred embodiments described herein without departing from the spirit and scope of the invention. It is our intention, however, that all such revisions and modifications that are evident to those skilled in the art will be included within the scope of the following claims.

What is claimed is:

1. A vacuum excavation system comprising:

a mobile base;

a spoils reservoir pivotally combined with the mobile base, said spoils reservoir having a first end wall and a second end wall so that when the reservoir is pivoted the first end wall will be elevated above the second end wall;

a manifold system having a plurality of openings formed therein;

a fluid supply connected to the manifold system;

said manifold system being combined with the first end wall of the spoils reservoir to deliver fluid from the fluid supply through the openings into the spoils reservoir;

a vacuum assembly combined with the spoils reservoir and being adapted to allow fluid communication with the spoils reservoir; and a control means for selectively permitting flow between the manifold and fluid supply and between the spoils reservoir and vacuum assembly.

2. The vacuum excavation system of claim 1 wherein:

the spoils reservoir has a vacuum port, an inlet line port, and an evacuation line port formed therein, said vacuum excavation system further comprising:

a vacuum line having a first end and a second end, said vacuum line first end being connected to the vacuum port, and said vacuum line second end being combined with the vacuum assembly;

an evacuation line connected to the evacuation line port, and an inlet line connected to the inlet line port.

3. A vacuum excavation system comprising:

a mobile base; a spoils reservoir pivotally combined with the mobile base, said spoils reservoir having a first end wall and a second end wall so that when the reservoir is pivoted the first end wall will be elevated above the second end wall;

a manifold system having a plurality of openings formed therein;

a pneumatic fluid supply connected to the manifold system;

said manifold system being combined with the first end wall of the spoils reservoir to deliver air from the fluid supply through the openings into the spoils reservoir;

an air mover having a suction inlet and an exhaust outlet formed therein;

a valve in fluid communication with the spoils reservoir, the manifold, the suction inlet, and the exhaust outlet, said valve having a first position and a second position;

said valve first position being adapted to allow air to flow from the spoils reservoir to the suction inlet and to substantially prevent the flow of air from the exhaust outlet to the manifold; and said valve second position being adapted to allow air to flow from the exhaust outlet to the manifold and to substantially prevent the flow of air from the spoils reservoir to the suction inlet.

4. The vacuum excavation system of claim 3 further comprising:

a filter system in series and communicating with the spoils reservoir and the air mover.

5. The vacuum excavation system of claim 4 wherein:

the filter system comprises a low velocity separator.

6. The vacuum excavation system of claim 3 wherein:

the air mover is a rotary vane pump.

7. The vacuum excavation system of claim 3 wherein:

the valve is in further communication with a muffler; and the valve permits air to flow from the exhaust outlet to the muffler when the valve is in the first position, and the valve permits air to flow from the muffler to the manifold when the valve is in the second position.

8. The vacuum excavation system of claim 3 further comprising:

a water reservoir combined with the mobile base; and a water pump to provide water at an excavation site to loosen packed material and aid in the creation of a slurry.

9. The vacuum excavation system of claim 8 further comprising:

a tank providing a water reservoir, said tank being separate from the spoils reservoir.

10. The vacuum excavation system of claim 3 further comprising a lift member disposed upon said mobile base for pivoting the first end of said spoils reservoir above said mobile base.

* * * * *